US007811081B2

(12) United States Patent
Nigro et al.

(10) Patent No.: US 7,811,081 B2
(45) Date of Patent: Oct. 12, 2010

(54) OFF-GAS FLARE

(75) Inventors: Robert C. Nigro, Jackson, WY (US); David H. Moneyhun, Rock Springs, WY (US); David W. Nichols, Rock Springs, WY (US)

(73) Assignee: Moneyhun Equipment Sales & Service, Rock Springs, WY (US)

( * ) Notice: Subject to any disclaimer, the term of this patent is extended or adjusted under 35 U.S.C. 154(b) by 148 days.

(21) Appl. No.: 12/148,538

(22) Filed: Apr. 18, 2008

(65) Prior Publication Data

US 2009/0263755 A1 Oct. 22, 2009

(51) Int. Cl.
*F23G 7/08* (2006.01)

(52) U.S. Cl. ..... 431/202; 431/331; 431/333; 95/166

(58) Field of Classification Search ..... 431/202, 431/5, 333, 331; 55/392, 338.1; 96/204, 96/166

See application file for complete search history.

(56) References Cited

U.S. PATENT DOCUMENTS 3,408,167 A 10/1968 Burden, Jr.
3,497,308 A 2/1970 Flynn
3,566,809 A 3/1971 Carry et al.
3,607,120 A 9/1971 Nesbitt et al.
3,771,940 A 11/1973 Stranahan et al.
3,807,940 A 4/1974 Juricek
3,822,984 A 7/1974 Straitz, III
3,829,964 A 8/1974 Critchlow et al.
3,850,581 A 11/1974 Hills et al.
3,852,023 A 12/1974 Itoh et al.
4,548,577 A 10/1985 McGill
4,610,622 A 9/1986 Quinnell
4,856,985 A 8/1989 Ochel et al.
4,941,415 A 7/1990 Pope et al.
4,975,042 A 12/1990 Schwartz et al.
5,396,960 A 3/1995 Marcott et al.
5,735,680 A 4/1998 Henkelmann
5,810,578 A 9/1998 Hystad et al.
6,010,674 A * 1/2000 Miles et al. ..... 423/245.3
6,012,917 A 1/2000 Wiseman
6,224,369 B1 * 5/2001 Moneyhun ..... 431/202

(Continued)

FOREIGN PATENT DOCUMENTS

WO WO 2006/010693 2/2006

(Continued)

*Primary Examiner*—Kenneth B Rinehart
*Assistant Examiner*—Hassan Brown
(74) *Attorney, Agent, or Firm*—Thorpe North & Western, LLP

(57) ABSTRACT

An off-gas flare system for disposing of a waste gas stream containing BTEX and VOC contaminants, and for safely handling slugs of excess liquids entrained in the waste gas stream. The flare system includes a flare stack, an enclosed steam tank disposed within the flare stack for receiving the waste gas stream and vaporizing any liquids in the waste gas stream into vapors, and an enclosed liquid tank disposed below the steam tank and in fluid communication with the steam tank for receiving the heated waste gas and liquid vapors and for temporarily containing any excess non-vaporized liquids. The flare also includes a waste gas burner disposed in the flare stack adjacent the steam tank and in fluid communication with the liquid tank, and a continuous means for igniting the waste gas burner.

20 Claims, 7 Drawing Sheets

U.S. PATENT DOCUMENTS

| | | | | |
|---|---|---|---|---|
| 6,485,292 | B1 * | 11/2002 | Rhodes et al. | 431/202 |
| 6,605,138 | B2 | 8/2003 | Frondorf | |
| 6,964,729 | B1 | 11/2005 | Khosrowyar | |
| 7,141,099 | B2 * | 11/2006 | Ross et al. | 96/155 |

FOREIGN PATENT DOCUMENTS

| | | |
|---|---|---|
| WO | WO 2006/082169 | 8/2006 |

* cited by examiner

OFF-GAS FLARE

FIELD OF THE INVENTION

The field of the invention relates generally to the disposal of VOC and/or BTEX contaminated waste gas, and more specifically to flare stacks for disposing of a VOC and/or BTEX off-gas stream produced by dehydrators associated with the production of natural gas, hydrocarbon or volatile liquid storage tanks, and the like.

BACKGROUND OF THE INVENTION AND RELATED ART

When natural gas is extracted from a subterranean formation it flows to the earth's surface and is collected at the well site. Natural gas contains essentially hydrocarbons, but invariably includes entrained water that is usually in the form of water vapor. The raw gas can also include, depending upon the nature of the underground reservoir, pollutants such as hydrogen sulfide (H2S), volatile organic compounds (VOCs), and other contaminants such as BTEX (benzene, toluene, ethylbenzene and xylenes).

Entrained water is a problem to the transportation, storage and use of natural gas, as it readily condenses into liquid when cooler temperatures and decreased vapor pressure are encountered at the earth's surface. The entrained water can cause problems in pipeline and process equipment including corrosion, and collects in low places in a pipeline where it can freeze into an ice with cold temperatures, to a point that the flow through a line can be severely restricted or blocked. Accordingly, in the oil and gas industry it is customary to extract as much of the entrained water as possible before the natural gas is passed to a pipeline for transportation to an area for storage or use.

The most common means employed in the petroleum industry to extract water from natural gas is by the use of liquid dehydrators. In this process the natural gas is conducted into a vessel, commonly known as a contacting tower or scrubber, in which it is intimately mixed with a liquid desiccant such as glycol. Glycol makes an ideal liquid desiccant for natural gas because it is relatively inexpensive, has a relatively high boiling point, does not easily oxidize and is recyclable. When the natural gas contacts the glycol, the entrained water or water vapor carried in the natural gas is absorbed by the glycol. The dehydrated or "dry" natural gas can then separated from the glycol and passed to a pipeline for storage or use.

Meanwhile, the glycol (referred to as "wet glycol"), is conducted to a separate vessel, commonly known as a reboiler or reconcentrator, where the wet glycol is heated to a temperature above the boiling point of water but below the boiling point of the glycol, allowing the glycol to remain in a liquid state while the water is boiled off and converted to a vapor state. The "dry glycol" can then be cycled back to the scrubber for the treatment of additional natural gas.

In the past, the vapor that was created in the reboiler was simply vented to the atmosphere. If the vapor is one-hundred percent water, that is pure water, the venting of the water vapor to the atmosphere is not harmful to the environment. Inevitably, however, the vapor passing from a glycol reboiler includes other contaminants and pollutants, particularly BTEX and VOCs, and venting these contaminants to the atmosphere is becoming an increasing environmental problem. Environmental laws have been enacted in recent years that mandate that the discharge of these pollutants to the atmosphere should be substantially reduced, if not eliminated.

SUMMARY OF THE INVENTION

In light of the problems and deficiencies inherent in the prior art, the present invention seeks to overcome these by providing a flare system for disposing of a dehydrator waste gas stream and temporarily containing any excess liquids. In accordance with one embodiment, the flare system of the present invention can include a flare stack, an enclosed steam pot disposed in the flare stack for receiving the waste gas stream and vaporizing any liquids in the waste gas stream into vapors, and an enclosed liquid tank disposed below the steam pot and in fluid communication with the steam pot for receiving the heated waste gas and liquid vapors and for temporarily containing any excess non-vaporized liquids. The flare system can also include a waste gas burner disposed in the flare stack adjacent the steam pot and in fluid communication with the liquid tank, as well as a means for igniting the waste gases flowing through the waste gas burner.

In accordance with another embodiment of the present invention for disposing of a dehydrator waste gas stream and temporarily containing any excess liquids, the flare system the present invention can comprise a flare stack with a steam pot assembly supported within the flare stack. The steam pot assembly can include an upper enclosed steam pot with an inlet for receiving the waste gas stream and vaporizing any liquids in the waste gas stream into vapors, and a lower enclosed liquid tank disposed below the upper steam pot for receiving the heated waste gas and liquid vapors. The flare system can further include a waste gas burner assembly that comprises a mixer for combining the heated waste gas and any liquid vapors with a source of combustion air, and a waste gas burner for burning the mixture of heated waste gas, liquid vapors and combustion air, and heating the upper steam pot. The flare system can also include a means for igniting the mixture of heated waste gas, liquid vapors and combustion air flowing through the waste gas burner. Furthermore, the upper steam pot can be configured to direct excess liquid from the waste gas stream to the lower liquid tank, and the lower liquid tank can be configured to receive and control the excess liquid for storage and evaporation.

In another embodiment, the present invention includes the method for disposing of entrained pollutants in a waste gas stream. The method can include introducing the waste gas stream to an upper enclosed steam tank, heating the waste gas stream to vaporize any excess liquids into liquid vapors, and passing the waste gas stream into a lower liquid tank to contain any non-vaporized excess liquids. The method can further include combining the heated waste gas stream from the lower liquid tank with combustion air in a mixer, and burning the mixture of the waste gas stream and combustion air in a waste gas burner.

The present invention can also include the method for disposing of entrained pollutants in a dehydrator off-gas waste stream, which comprises cooling the off-gas stream to separate a liquid stream from a waste gas stream, transporting the waste gas stream with excess liquids to an upper steam pot, heating the waste gas stream to vaporize the excess liquids into liquid vapors, and passing the waste gas stream into a lower liquid tank to contain any non-vaporized excess liquids. The method can also include combining the heated waste gas and liquid vapors with combustion air in a mixer; and burning the mixture of waste gas, liquid vapors and combustion air in a waste gas burner.

BRIEF DESCRIPTION OF THE DRAWINGS

Features and advantages of the invention will be apparent from the detailed description that follows, and which taken in conjunction with the accompanying drawings, together illustrate features of the invention. It is understood that these drawings merely depict exemplary embodiments of the present invention and are not, therefore, to be considered limiting of its scope. And furthermore, it will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings, in which.

DETAILED DESCRIPTION OF EXEMPLARY EMBODIMENTS

The following detailed description of the invention makes reference to the accompanying drawings, which form a part thereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. As such, the following more detailed description of the exemplary embodiments of the present invention is not intended to limit the scope of the invention as it is claimed, but is presented for purposes of illustration only: to describe the features and characteristics of the present invention, and to sufficiently enable one skilled in the art to practice the invention. Accordingly, the scope of the present invention is to be defined solely by the appended claims.

The present invention describes a system and method for disposing of a waste gas containing VOC and/or BTEX contaminants. In one exemplary embodiment, the present invention can be used to dispose of a waste gas stream produced by the glycol regenerator in a natural gas wellhead's dehydrator unit, also known as the dehydrator off-gas stream. The off-gas stream from the dehydrator can include water vapor as well as volatile waste gases with entrained BTEX and VOC components, and can be considered hazardous to the environment. The Off-Gas Flare of the present invention can efficiently and reliably destroy or render harmless the contaminating pollutants before they are released to the atmosphere. It is to be appreciated, however, that the present invention is not limited to applications with dehydrators, and can be used in other situations involving the disposal of waste gas containing VOC and/or BTEX contaminants, including but not limited to the disposal of VOCs released from the top of hydrocarbon or volatile liquid storage tanks, etc.

The following detailed description and exemplary embodiments of the dehydrator off-gas flare will be best understood by reference to the accompanying drawings, wherein the elements and features of the invention are designated by numerals throughout.

Figure 1:
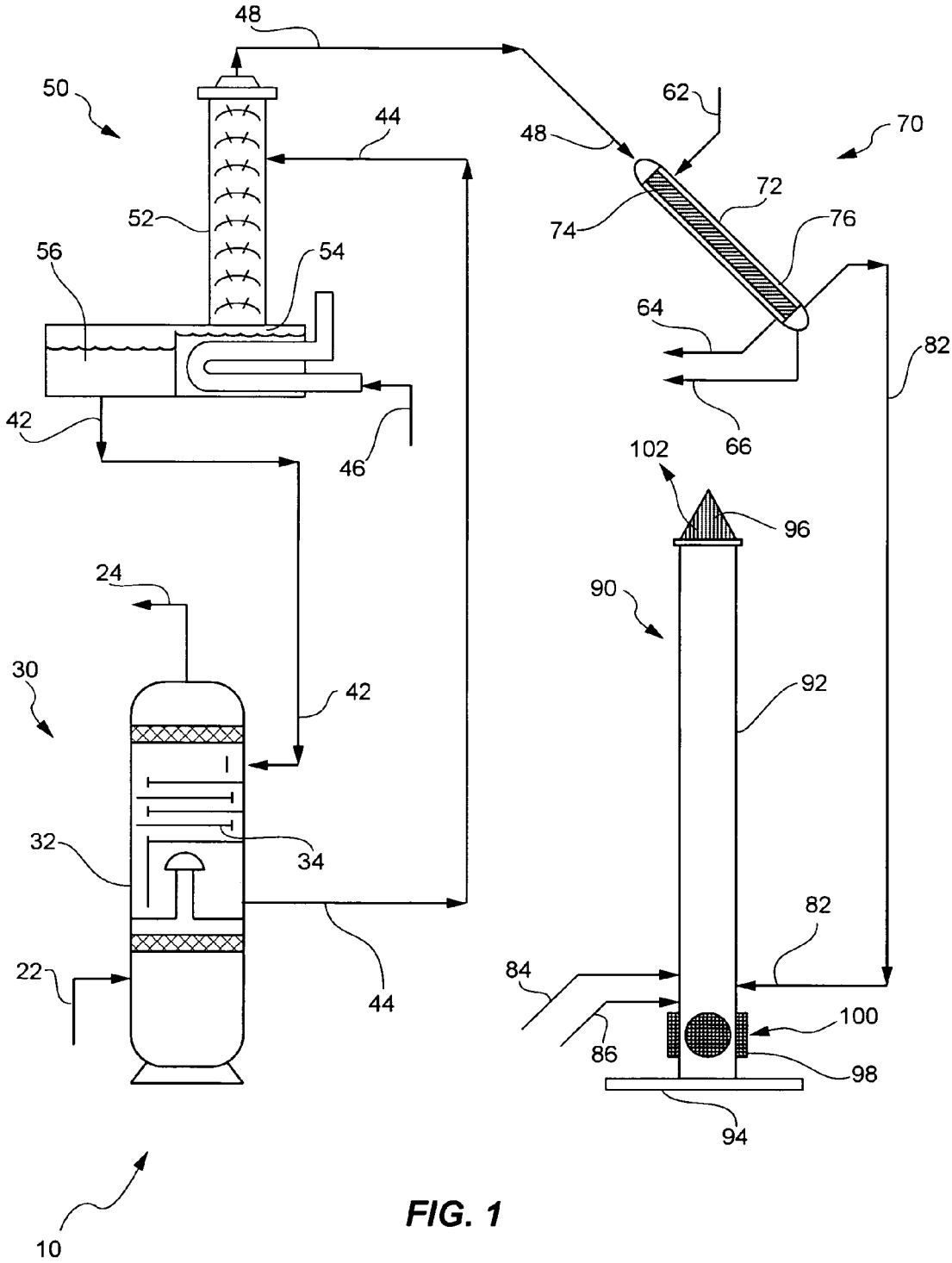
FIG. 1 is a schematic diagram of a liquid dehydration system for natural gas, as utilized by an embodiment of the present invention.

Illustrated in FIG. 1 is a diagram of a simplified natural gas dehydration system 10, or dehydration unit, which uses a liquid glycol desiccant. Although various modifications can be made to this process, the two major components are generally constant with most liquid glycol dehydration systems: a contactor or scrubber 30 where the glycol comes into contact with the natural gas to absorb the entrained water, and a reconcentrator or a reboiler 50 where the captured water is removed from the glycol through heating and vaporization.

Before arriving at the scrubber 30, any free liquid in the natural gas stream, such as oil and liquid water, can be removed in a prior separation step (not shown) to form a stream of "wet" or hydrated natural gas 22.

As shown in FIG. 1, the stream of wet natural gas 22, containing water vapor and other contaminants, can enter the scrubber or contactor tower 32 at the bottom of the vessel. Once inside, the natural gas mixture is allowed to proceed upward through the scrubber tower while dehydrated, dry liquid glycol 42 is introduced into the top of the tower. The glycol is allowed to flow downwards in a direction counter to the upwards current of the natural gas mixture. As the glycol and the gas mixture pass through packing material or trays 34 in opposite directions, the two streams come into intimate contact, during which a majority of the water vapor and liquid water, including the suspended contaminants, is absorbed by the glycol. The dehydrated natural gas stream 24 is then allowed to exit out the top of the contactor tower 30, where it may be delivered for transportation and storage or for use elsewhere in the wellhead processing system.

The stream of water and contaminant-enriched glycol 44 also exits the contactor tower 30 and is directed to the reconcentrator or reboiler 50. The reboiler can include a still column 52, a firebox section 54 and surge section 56. The hydrated glycol 44 is introduced into the still column 52, where the glycol is separated from the water and contaminants as it flows downward toward the firebox section 54 and eventually to the surge section 56, from where it is cycled back to the scrubber 30 through dehydrated liquid glycol stream 42 for the dehydration process to be repeated.

The water and contaminants are separated from the glycol when it is heated in the firebox 54 and still column 52 to a temperature of between 380° and 400° Fahrenheit without increasing the pressure. At this temperature and pressure the water boils into steam, but the glycol has a higher boiling point and will not vaporize. Fuel gas 46 may be used as the source of energy to heat the glycol in the U-shaped firebox 54. An off-gas stream 48, comprised primarily of vaporized water and residual BTEX and/or VOC waste gases, can be withdrawn off the top of the still column 52. In the past, the contaminated off-gas stream 48 was vented directly to the atmosphere, where the odorous vapors created uncomfortable living conditions and health concerns for local residents and workers. However, in recent years this source of emissions has become subject to environmental laws that mandate that the discharge of these pollutants to the atmosphere be substantially reduced or eliminated.

As illustrated above, the simplified liquid dehydration process for natural gas is provided by way of background only, and does not constitute the present invention.

As an alternative to venting to the atmosphere, the dehydrator off-gas stream 48 can be directed to a condenser 70 where it can be cooled by a side stream of dry natural gas 62. Inside the condenser the natural gas is kept separate from the off-gas stream that flows through the inside passages of the condenser tubing 74. Instead, the cooling dry gas passes between the shell side 76 of the tubing and the outer vessel 72 of the condenser, removing heat from the off-gas stream during its passage towards the dry gas outlet 64. Inside the condenser tubing, the off-gas stream is cooled to a temperature between 110° and 140° Fahrenheit, which condenses out a significant portion of the water vapor and BTEX as liquid that can be removed through the condensed liquid outlet 66 for storage and disposal.

What remains after removal of the condensed liquid is a flammable stream of unwanted waste gas 82 comprising BTEX and VOC gases, water vapor, and potentially a small natural gas component, as well as some residual liquid water from the condenser. The waste gas stream 82 can be sent to the dehydrator off-gas flare 90 of the present invention, where it can be burned or incinerated to produce inert, non-toxic products of combustion. The off-gas flare 90 can include a flare stack 92 supported by a base 94. In addition to the waste gas stream, fuel gas can be provided for both a pilot burner 84 and a controllable fluff gas burner 86, while combustion air 100 for burning the waste gas can enter the bottom portion of the flare stack through flame arrestors 98. Exhaust gases 102 and inert products of combustion can exit the flare stack through the top opening, which can be caped by a mesh screen forming a spark arrestor 96.

As with many oil and gas processes, the natural gas dehydration process described above is subject to occasional upsets, which can result in a volume or slug of excess liquid being included in the waste gas stream 82 traveling from the condenser 70 to the flare 90. Depending upon the nature of the process upset, the excess liquids can include liquid glycol from the reboiler still 52. If not dealt with properly, the excess liquids can contact the burner and extinguish the flame, or if flammable, create an excess of flame that is dangerous and can damage the waste gas burner and other components inside the flare stack. Moreover, liquids on the burner can boil away leaving a coke residue that can foul or clog the burner.

As slugs of liquid reaching the flare stack increases the risks of fire and explosion and the inadvertent release of waste gas to the atmosphere, the consequence is often an automatic shut-down of the dehydration and flare system. This in turn reduces well-head production and can require a technician call-out to restore the process and restart the flare. Since many wellheads and natural gas dehydration systems are located in remote locations far from human supervision, a technician could take hours or days to respond to the call-out. It is therefore advantageous to provide the dehydrator off-gas flare of the present invention with the capability of reliably handling slugs of excess liquids without extinguishing or damaging the waste gas burner, automatically shutting down the dehydration unit and/or shutting in the wellhead, or releasing untreated pollutants into the environment.

Each of the above-recited advantages will be apparent in light of the detailed description set forth below, with reference to the accompanying drawings. These advantages are not meant to be limiting in any way. Indeed, one skilled in the art will appreciate that other advantages may be realized, other than those specifically recited herein, upon practicing the present invention.

Figure 2:
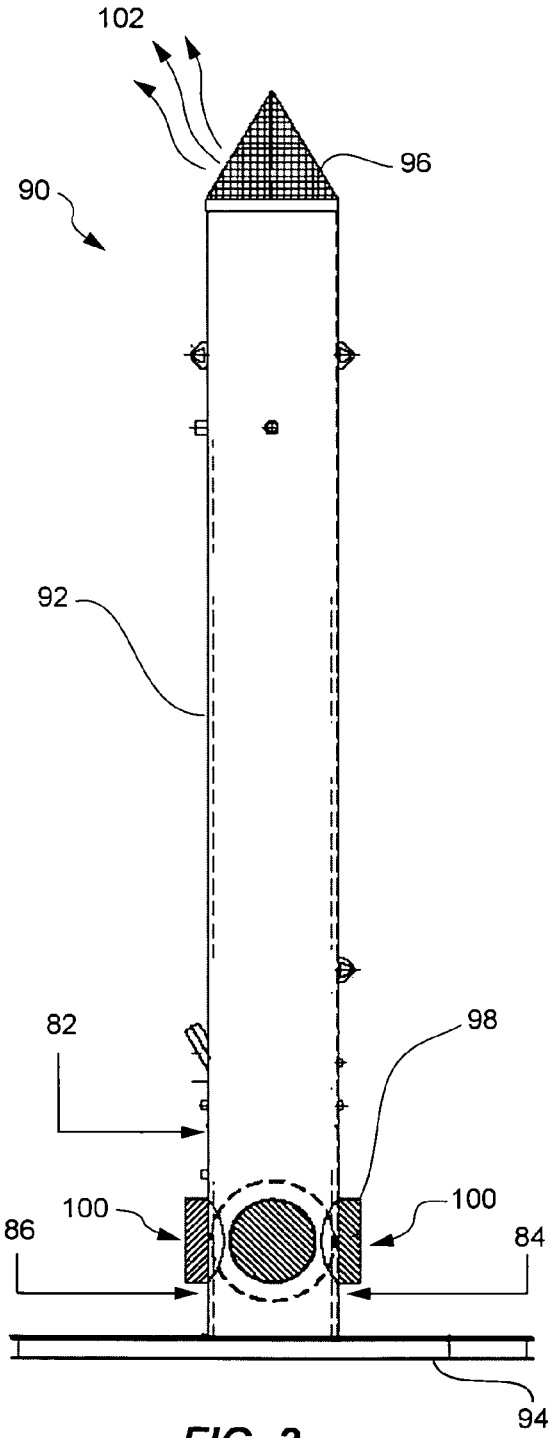
FIG. 2 is an illustration of the exterior surface of the BTEX flare, according to an embodiment of the present invention.
Figure 3:
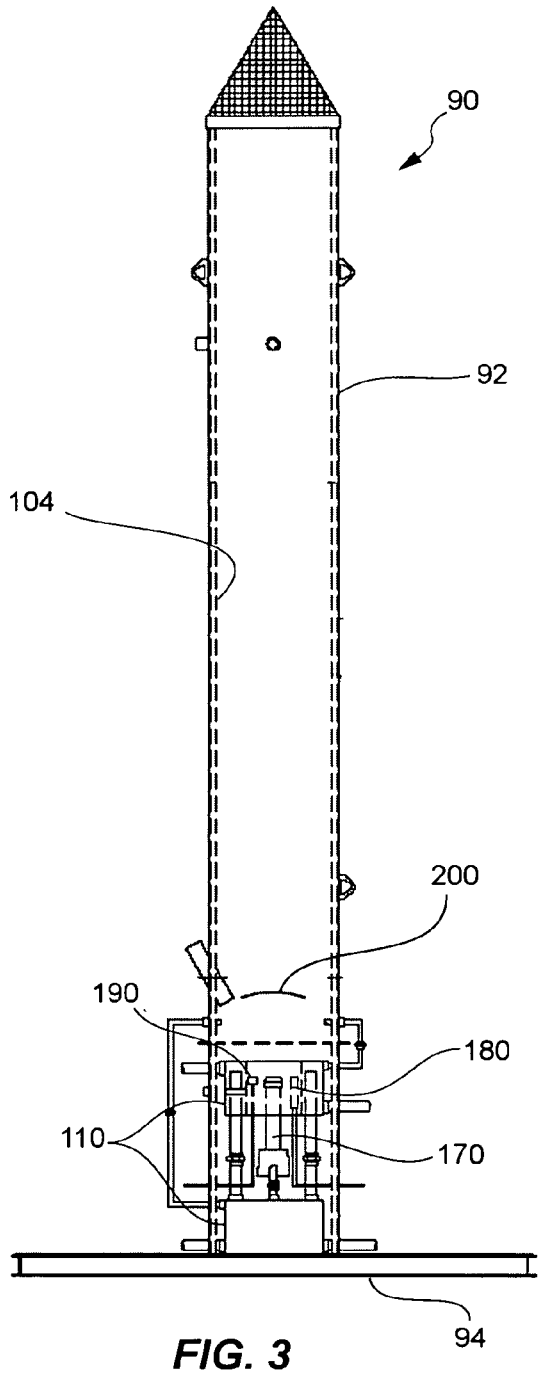
FIG. 3 is an cut-away illustration of the general interior workings of the BTEX flare, according to an embodiment of the present invention.

One solution to the problems described above is the dehydrator off-gas flare 90 of the present invention, as generally illustrated in FIGS. 2 and 3 and described in more detail hereinafter. Shown in FIG. 2 is the exterior of the off-gas flare 90 that can include a flare stack 92 supported on a base 94. The stack is useful for creating a chimney effect that can draw in cool, combustion air 100 through bottom openings or portals which have been covered with flame arrestors 98, and exhaust hot products of combustion 102 out the top opening which has been covered with a spark arrestor 96. The flame arrestors 98 that can be placed over the combustion air openings serve as safety measures to prevent the open flames inside the flare stack from reaching and igniting any accidental accumulation of flammable gases that might inadvertently form in the environment surrounding the wellhead. The spark arrestor 96 or screen on the top of the stack 92 is another safety measure which prevents any sparks or pieces of burning material from escaping out the top of the stack and igniting combustible materials located adjacent the flare or wellhead.

FIG. 2 also illustrates the several input streams into the flare 90, including primarily the waste gas stream 82 which flows from discharge of the condenser. Additional fuel gas for a pilot burner can be provided by pilot gas input 84, while fuel gas for a controllable "fluff" gas burner can be provided by fluff gas input 86. Various other components and accessories mounted either on the exterior of the stack 92 or adjacent the flare system 90, such as an electronic control system, sensor ports, a fire prevention system, etc., can be included with the flare system but are not shown in detail in FIG. 2.

The interior of the flare 90 is generally shown in FIG. 3. The flare stack 92 can include an interior liner of insulation or refractory material 104 which serves to contain the flames, define the zone of combustion, and prevent excess heat from reaching and damaging the metal exterior of the stack 92. Located in the bottom portion of the stack and inside the insulating liner is the steam pot assembly 110 and the waste gas burner assembly 170, which are the two components used to control and burn the waste gas. Positioned adjacent to the waste gas burner assembly is the pilot burner 180 which can provide a continuous ignition source for the waste gas stream, and the fluff gas burner 190 which can maintain a constant level of heat to the steam pot assembly during periods of low waste gas production. The pilot burner is in fluid communication with the pilot fuel gas stream 84. The fluff gas burner is in fluid communication with the fluff burner fuel gas stream 86. A deflector plate 200 can also be included inside to stack to create an expanded zone of combustion that provides for a more complete and reliable combustion and disposal of pollutants.

Figure 4A:
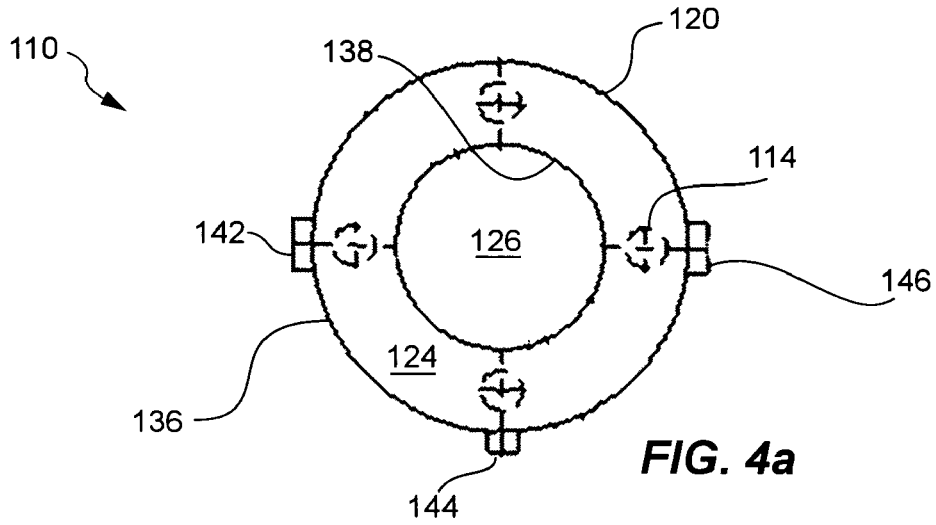
FIG. 4*a* illustrates a top view of the steam pot assembly, according to the embodiment of FIG. 3.
Figure 4B:
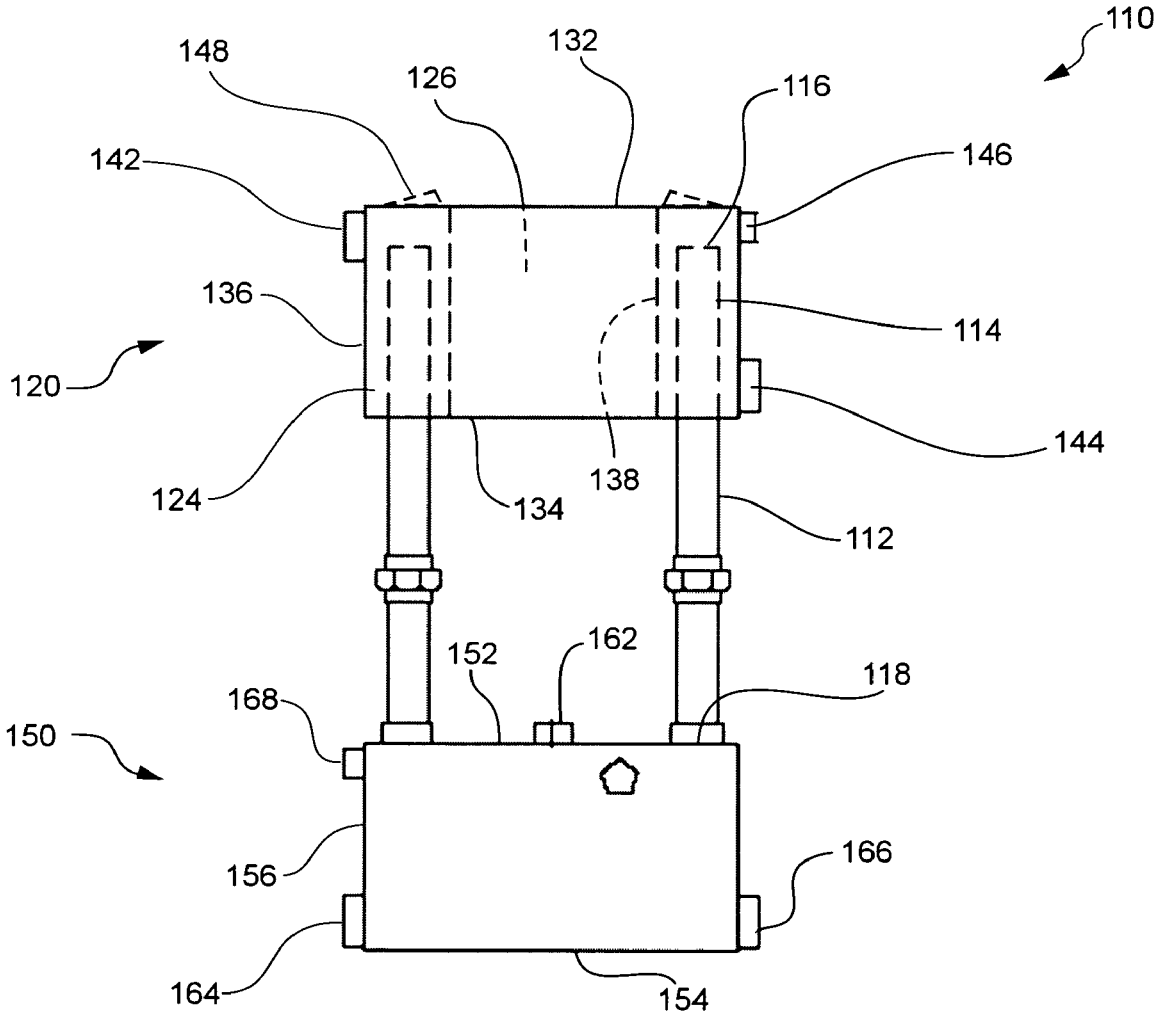
FIG. 4*b* illustrates a side view of the steam pot assembly, according to the embodiment of FIG. 3.

FIGS. 4*a* and 4*b* illustrate the steam pot assembly 110 in greater detail. The steam pot assembly can be comprised of an upper steam pot 120, in fluid communication with a lower liquid tank 150 through a number of hollow support tubes 112. The steam pot assembly can be sized and configured to slide into the lower portion of flare stack, and the upper steam pot 120 can have the same or slightly smaller diameter than the lower liquid tank 150.

The upper steam pot 120 can be an enclosed tank having an annular interior volume 124 enclosed by a top plate 132, a bottom plate 134, cylindrical exterior wall 136 and a cylindrical interior wall 138. The steam pot can surround a central hollow space or volume 126. As will be discuss in more detail below, a waste gas burner can be positioned inside the central hollow space 126 to form a zone of combustion extending upwards from the hollow space to burn simultaneously the waste gases and provide heat to the steam pot. The upper steam pot 120 can be completely enclosed, such as with a solid or enclosed upper plate and solid or enclosed exterior and interior walls, except for one or more outlets to the lower liquid tank. The enclosed steam pot resists liquids from overflowing the steam pot and coming into contact with the burner.

The lower liquid tank 150 can be an enclosed tank having a top plate 152, a bottom plate 154 and a cylindrical exterior sidewall 156, and can be given a capacity sufficient to hold the anticipated volumes of most slugs of excess liquid. In one embodiment of the present invention, the lower liquid tank 150 can be configured to fit inside the interior volume of the flare stack. In another embodiment, the liquid tank can be integrally formed with the lower portion of the flare stack, with the exterior wall of the flare stack doubling as the sidewall 156 of the liquid tank. The lower liquid tank 150 can have a volume greater than the volume of the upper steam pot 120 to contain liquids from the stream of waste gas.

The upper steam pot 120 and lower liquid tank 150 are joined by support tubes 112 that can be attached to both the bottom plate 134 of the upper steam pot and the top plate 152 of the lower liquid tank. In the embodiment shown in FIG. 4, four support tubes serve to support the steam pot above the liquid tank. The upper portions 114 of the support tubes 112 can extend through the bottom plate of the steam pot and up into the internal volume 124. The upper portions of the support tubes can terminate in openings 116, which can be positioned a distance 128 from the top plate 132, leaving a gap between the openings and the bottom surface of the top plate. In one embodiment, the gap 128 between the openings 116 and the top plate 132 can be about two inches. At their lower ends, the bottom portions of the support tubes 112 can connect through the top plate 152 of the liquid tank, forming openings 118 that allow fluids to enter the liquid tank 150 from above. Thus, the hollow centers of the support tubes 112 can provide multiple passageways for the waste gas and excess liquids to flow from the upper steam pot 120 into the lower liquid tank 150.

The upper steam pot 120 can have a waste gas inlet 142 that allows the stream of waste gas and any excess liquids 82 from the condenser (see FIG. 1) to enter the interior volume 124 of the steam pot. During normal operation, the waste gas can flow into the upper steam pot, circulate around the annular interior volume, into the top openings 116 in the upper portions of the support tubes 114, and down through the multiple support tubes 112 into the lower liquid tank. With the top openings 116 raised above the bottom plate 134 of the steam pot to form a tank, a small amount of excess liquids entering the steam pot assembly 110 can be captured in the lower portion of the steam pot.

The upper steam pot 120 can be heated by the waste gas burner or the fluff gas burner to a temperature approaching 500° Fahrenheit, which is higher than the vaporization point of water, glycol and BTEX. This can be sufficient to boil the small amount of excess liquid captured in the annular volume 124 into heated liquid vapors, which can then join the stream of heated waste gases flowing down the support tubes to the lower liquid tank below. In one embodiment, the upper steam pot can configured with a capacity to hold and vaporize about four to five gallons of liquid.

The upper steam pot 120 can also be configured with a flush outlet 144 to a drain valve that allows the steam pot to be drained and cleaned during periodic maintenance cycles. The flush outlet can be located lower in the exterior sidewall 136 of the steam pot to allow for complete drainage. The upper steam pot can also be configured with an over-pressure outlet 146 leading to a pop-off valve and vent line to allow for the release the heated waste gases and liquid vapors in the event of a line blockage or development of excess pressure.

In an alternative embodiment, the upper steam pot can be configured with nozzles 148 in the top plate 132 for allowing a by-pass portion of the heated waste gases and liquid vapors to flow directly into the zone of combustion. The nozzles can be controllable to allow for greater by-pass flow during periods of high production of waste gases and liquid vapors, or lesser by-pass flow during periods of low production.

As shown in FIG. 4*b*, the liquid tank 150 can receive the heated waste gases and liquid vapors through the inlet support tube openings 118 in the top plate 152 of the tank. An outlet opening 162 leading to the burner assembly and the waste gas burner in addition can also be located in the top plate 152 of the liquid tank, forcing the heated waste gases and liquid vapors to make a sharp, 180° turn between the support tube inlet openings 118 and the outlet opening 162 to the burner assembly. This sudden change in direction can force residual droplets of liquids entrained in the gas flow to drop out against the sides and bottom of the liquid tank.

The lower liquid tank 150 in the steam pot assembly 110 can be located below both the upper steam pot 120 and the zone of combustion in the central hollow space 126, and can have a surface temperature during normal operation of the flare between 100°-200° Fahrenheit. Thus, the temperature differential between the exterior surfaces of the upper steam pot and the lower liquid tank can range from 300°-400° Fahrenheit. The waste gas and liquid vapors heated in the upper steam pot may not experience the complete temperature differential, however, as their passage down the support tubes, through the lower steam pot, and up to the waste gas burner may not allow enough time for the complete transfer of heat. Nevertheless, the temperature differential between the steam pot and the liquid tank can also cause some of the heated liquid vapors with higher boiling points to condense against the sides and bottom of the liquid tank.

As a natural consequence of both the sudden change in direction of the gas flow and the temperature differential between the heated gases and the cooler surfaces of the liquid tank, liquids can condense and accumulate in the bottom of the lower liquid tank 150. During normal operating conditions, much of this liquid can evaporate over time back into the gas stream passing through the upper portion of the liquid tank, to be carried to the waste gas burner. The lower liquid tank can be configured with a volume to hold up to twenty gallons or more of liquids, which can provide sufficient capacity to hold and evaporate the excess liquids produced during both normal operation and most process upset conditions. Excess liquids that fail to evaporate can be withdrawn or drained off through flush outlet 166.

The lower liquid tank 150 can also be configured with a flush inlet opening 164 that allows the liquid tank to be flushed and cleaned during periodic maintenance cycles, and an over-pressure outlet 168 leading to a pop-off valve and vent line to allow for the release the heated waste gases and liquid vapors in the event of a line blockage or development of excess pressure in the lower liquid tank.

Figure 5:
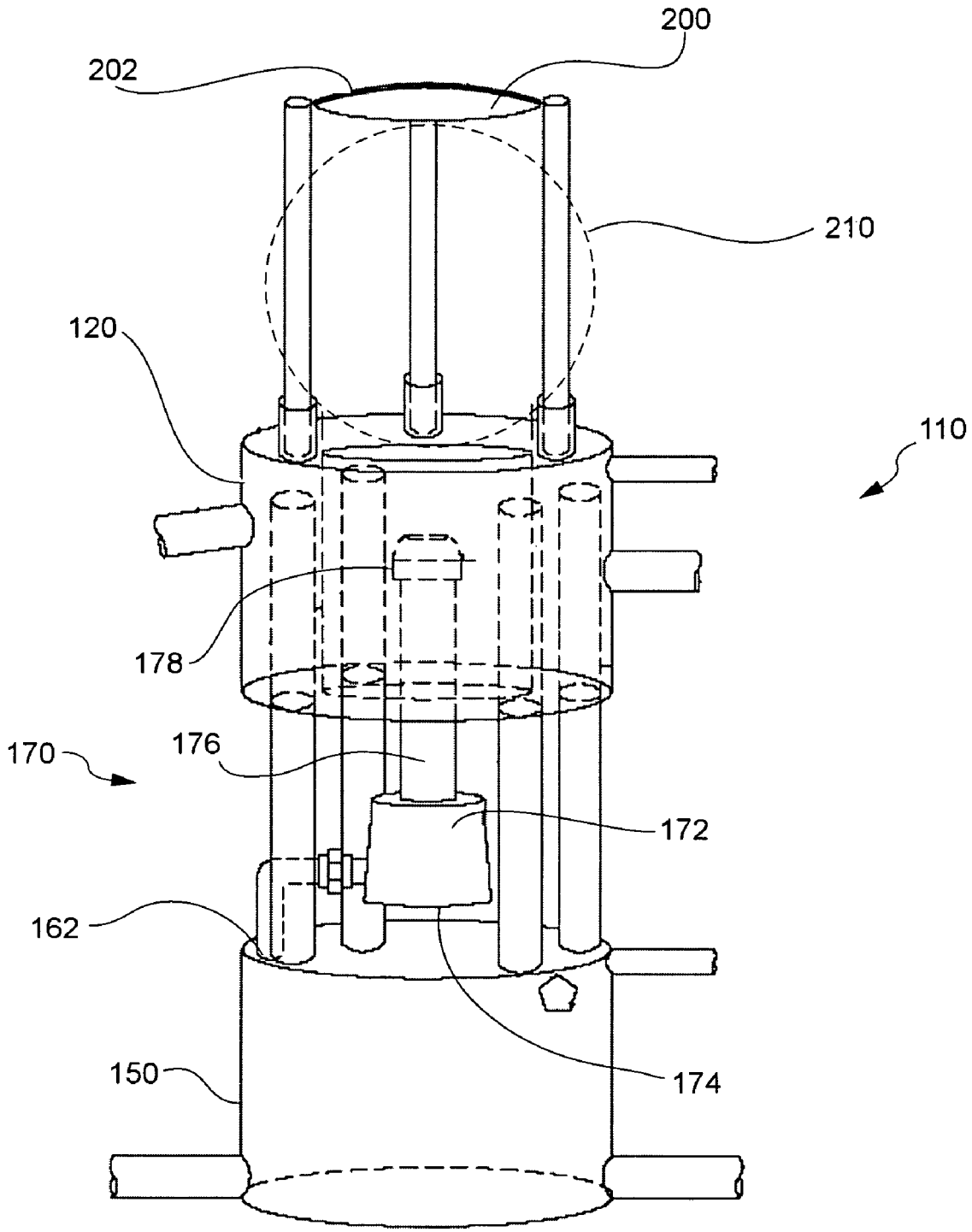
FIG. 5 illustrates a close-up perspective view of the steam pot and burner assemblies, according to the embodiment of FIG. 3.

FIG. 5 provides a perspective view of the steam pot assembly 110 integrated with burner assembly 170, according to the embodiment of the present invention illustrated in FIG. 3. The burner assembly can include a mixer 172 which combines the heated waste gases and liquid vapors flowing from the outlet opening 162 of the lower liquid tank 150 with combustion air entering the mixer through bottom opening 174. As described hereinabove, the combustion air can enter the flare stack through bottom openings or portals which have been covered with flame arrestors (see FIGS. 2-3), and which can be positioned at an elevation approximately equal to the level of the mixer 172 within the stack. The mixture of heated waste gases, liquid vapors and combustion air can then pass upwards through burner body 176 to the burner tip 178, which can be located inside the hollow space 126 formed in the center portion of annular upper steam pot 120. The burning of the waste gas within the central hollow space 126 of the steam pot serves to simultaneously combust the harmful BTEX and VOC gases into inert, non-toxic products of combustion, and to heat the steam pot 120 to a temperature that vaporizes newly arrived excess liquids.

Also shown in FIG. 5 is deflector shield 200 located some distance above the tip 178 of the waste gas burner. The deflector shield can expand the zone of combustion 210 from the central hollow space 126 immediately adjacent the waste gas burner 176 to the space between the burner tip 178 and the deflector shield 200 by obstructing the direct, linear escape of heat and exhaust gas away from the central hollow space 126 and up the flare stack. The deflection shield 200 tends to deflect or redirect the exhaust gas and heat back into the zone of combustion 210 and down towards the burner tip 178. It is believed that preventing the direct escape of the heat generated by the combustion process helps to heat the zone of combustion 210 to a more elevated temperature, such that the BTEX and VOC gases are more thoroughly combusted when first exiting the burner tip 178 of the waste gas burner 176. In addition, it is believed that the exhaust gas re-circulated back through the zone of combustion 210 carries back with it any non-combusted BTEX and VOC components for re-combustion, thus increasing the efficiency of the off-gas flare. As shown in FIG. 5, the deflection shield 200 may have a curved surface 202 for helping re-circulate the exhaust gases.

The deflector shield 200 is discussed in more detail in U.S. Pat. No. 6,224,369,filed Jun. 2, 1999, and entitled "Device and Method for Burning Vented Fuel", and is incorporated by reference in its entirety herein.

Figure 6:
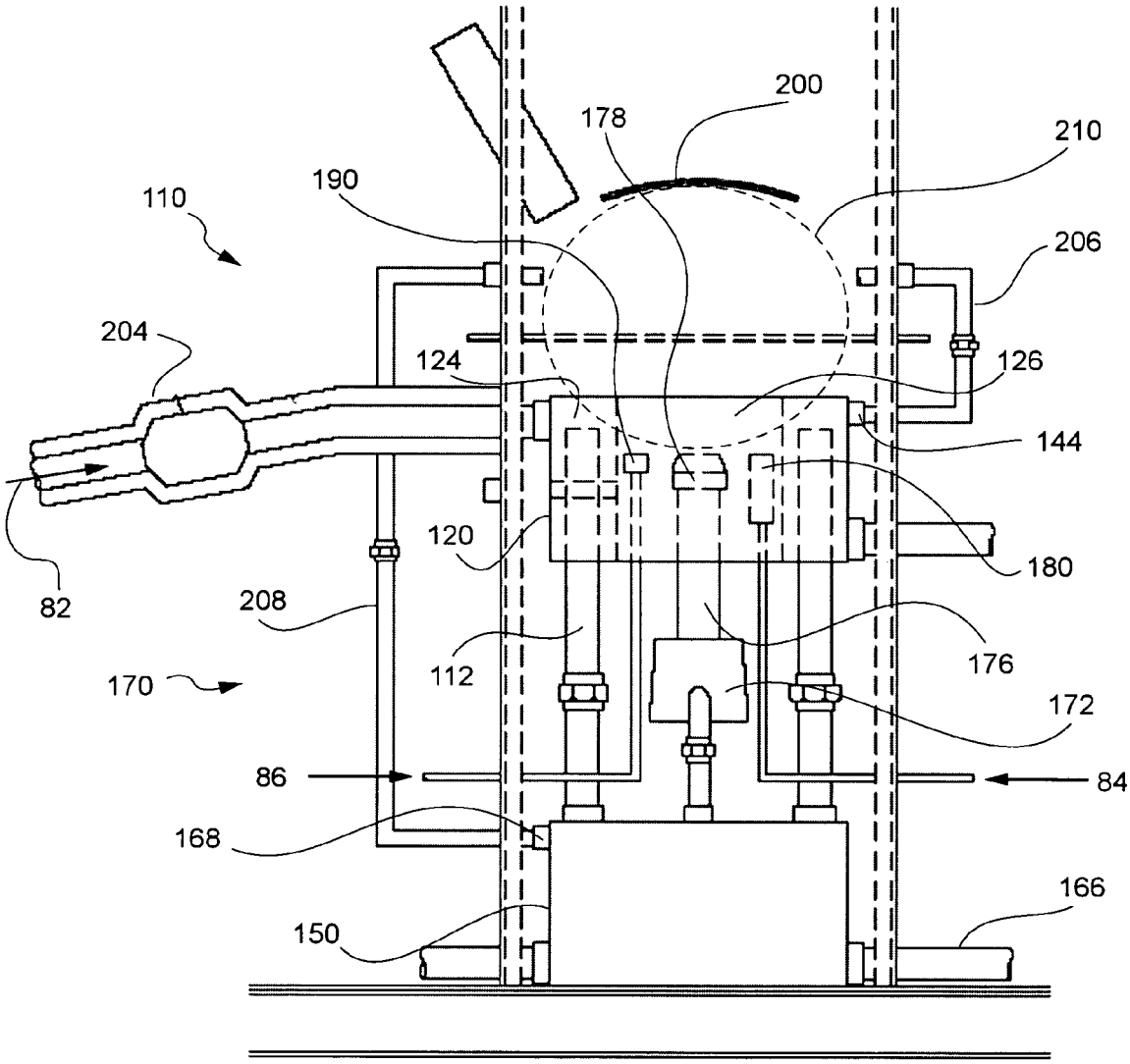
FIG. 6 illustrates a detailed cut-away side view of the bottom portion of the BTEX flare, according to the embodiment of FIG. 3.

Additional aspects of the present invention are shown in FIG. 6, which further illustrates the embodiment of the invention described in FIG. 3. In addition to the steam pot assembly 110 and the burner assembly 170, the embodiment can include a pilot burner 180 attached to a supply of fuel gas 84. Located adjacent the burner tip 178 and inside the central hollow space 126 defined by the annular upper steam pot 120, the pilot burner 180 acts as a continuous source of ignition to ignite the flammable waste gas stream as it exits the waste gas burner 176. It is possible for the stream of waste gases to the off-gas flare to vary in volume over the course of natural gas production from the wellhead, as the amount of entrained water and contaminants contained in the natural gas stream will fluctuate. If the amount of waste gas temporarily drops below a level sufficient to keep the waste gas burner operable, the pilot burner can re-ignite the waste gas burner when flow returns. The pilot burner can also re-ignite the burner if it is temporarily extinguished by a slug of non-flammable liquid, although this possibility can be significantly reduced by the dual enclosed upper steam pot and lower liquid tank assembly of the present invention, as discussed hereinabove.

A fluff gas burner 190 can also be located in the central hollow space 126 defined by the annular upper steam pot 120, and adjacent the pilot burner 180 and the burner tip 178 of the waste gas burner 176. The fluff gas burner 190 can be connected to a controllable source of fuel gas 86 that may be throttled by an exterior control device (not shown). During periods of low waste gas production, the flow of fuel gas to the fluff gas burner can be increased to maintain the zone of combustion 210 above a minimum temperature needed to completely combust the BTEX and/or VOC contaminants, and to keep the upper steam pot 120 at a high enough temperature to vaporize any excess liquids reaching the off-gas flare from the condenser.

Also shown in FIG. 6 is flame arrestor 204 installed in the inlet line for waste gas stream 82. The dual enclosed-tank configuration of the steam pot assembly is designed to control the flow of waste gases and excess liquids as it travels through the components of the off-gas flare, and to isolate the flammable gas from the flames until it finally reaches the tip 178 of the waste gas burner 176. This greatly reduces the risk of uncontrolled flare-ups present in other flare designs. Nevertheless, the flame arrestor can be installed in the waste gas inlet stream 84 to prevent any open flames from the waste gas 176, pilot 180, or fluff gas 190 burners from traveling back up the waste gas stream 84 and prematurely igniting the flammable waste gas leaving the condenser.

Additional safety features shown in FIG. 6 are the pressure relief, or pop-off, lines leading from the upper steam pot and the lower liquid tank to the zone of combustion 210 located between the burners and the deflector shield 200. Pop-off line 206 can connect to the pressure relief outlet 146 in the steam pot to allow any excess heated gases and liquid vapor to escape from the steam pot 120 in an accidental over-pressure situation. The waste gas and liquid vapors may not vented to the environment, but can be directed back to the zone of combustion 210 to ensure that all harmful products are combusted before leaved the flare stack. Likewise, pop-off line 206 can be connected to pressure relief outlet 168 in the liquid tank 150 to allow an inadvertent build-up of excess waste gases and liquid vapor to bypass the waste gas burner assembly 170 and pass directly into the zone of combustion 210.

As can be appreciated from the internal workings of the off-gas flare illustrated in FIG. 6, the dehydrator off-gas flare of the present invention provides for the efficient and reliable combustion of a waste gas stream 82 containing BTEX and/or VOC contaminants, while at the same time preventing damage and flare-ups from process upsets that can allow slugs of liquids to flow into the flare system.

During normal operation, the waste gases from the condenser can flow easily through the steam pot assembly 110, combine with combustion air in the mixer 172 and can be combusted at the tip 178 of the waste gas burner 176. Small amounts of excess liquids present in the waste gas stream can be captured and vaporized in the upper steam pot 120 which is maintained above the boiling temperature of the liquids by the waste gas burner 176 itself or by the supplementary fluff gas burner 190. The heated liquid vapors can then join the flammable waste gas as it passes down through the lower liquid pot and back up through the waste gas burner. Although the excess liquids and liquid vapors may not be flammable, as in the case of residual water and water vapor, the quantity of non-flammable vapors is not sufficient to prevent the complete combustion of the volatile BTEX and/or VOC gases waste gases in the zone of combustion 210. Indeed, it is believed that small amounts of water vapor or steam can improve the efficiency of the combustion process as well as scour clean the burner tip 178 of the waste gas burner 176 and prevent harmful build-up of residual char and coke that must be otherwise removed with periodic maintenance.

In the event of a process upset, a large volume or slug of excess liquid can enter the off-gas flare through inlet waste gas stream 82. In prior art systems, the slug of liquid could quickly fill any liquid-containing components and pass directly into the zone of combustion, choking off the flow of flammable waste gases to the burner and extinguishing the flame. Of if the slug were partially flammable, the liquids could ignite and create a flare-up of uncontrolled flames inside the flare stack that could damage or destroy the internal components of the flare. It can be appreciated that with the present invention, however, the slug of liquid can not pass directly into the zone of combustion from the upper steam pot 120, but instead can fill the internal annular volume 124 of the steam pot until it reaches the top openings in the support tubes 112, where it can flow downward through the inside of the tubes and into the lower liquid tank 150. From there, the slug of liquid can be temporarily stored or captured for evaporation back into the stream of heated waste gas, combustion in the waste gas burner and eventual release with the hot exhaust gases out of the top of the stack, or can be withdrawn through the flush outlet port 166. As the liquid tank can be given a capacity sufficient to hold most slugs of liquid, the off-gas flare can continue to operate uninterrupted through most process upsets. However, in the event of a continuous upset resulting in a lengthy stream of excess liquids to the flare, the lower liquid tank can be configured with a level switch and an automatic shutdown device to turn off the flare and/or shut down equipment to stop production, or with an automatic drain valve to removes the excess liquids from the lower tank. As the excess liquids will be prevented from directly reaching the waste gas burner in both embodiments, the internal components of the flare can be maintained in proper good and proper operating condition.

As a result, the flare of the present invention can overcome the problems found in the prior art by reliably handling slugs of excess liquids without extinguishing or flaring the waste gas burner, automatically shutting down the flare and/or shutting down other equipment, or releasing untreated pollutants into the environment. Moreover, the present invention can meet these challenges while efficiently disposing of the unwanted and hazardous BTEX and/or VOC waste gas emissions through incineration into inert, non-toxic products of combustion that can be safely released into the environment.

Figure 7:
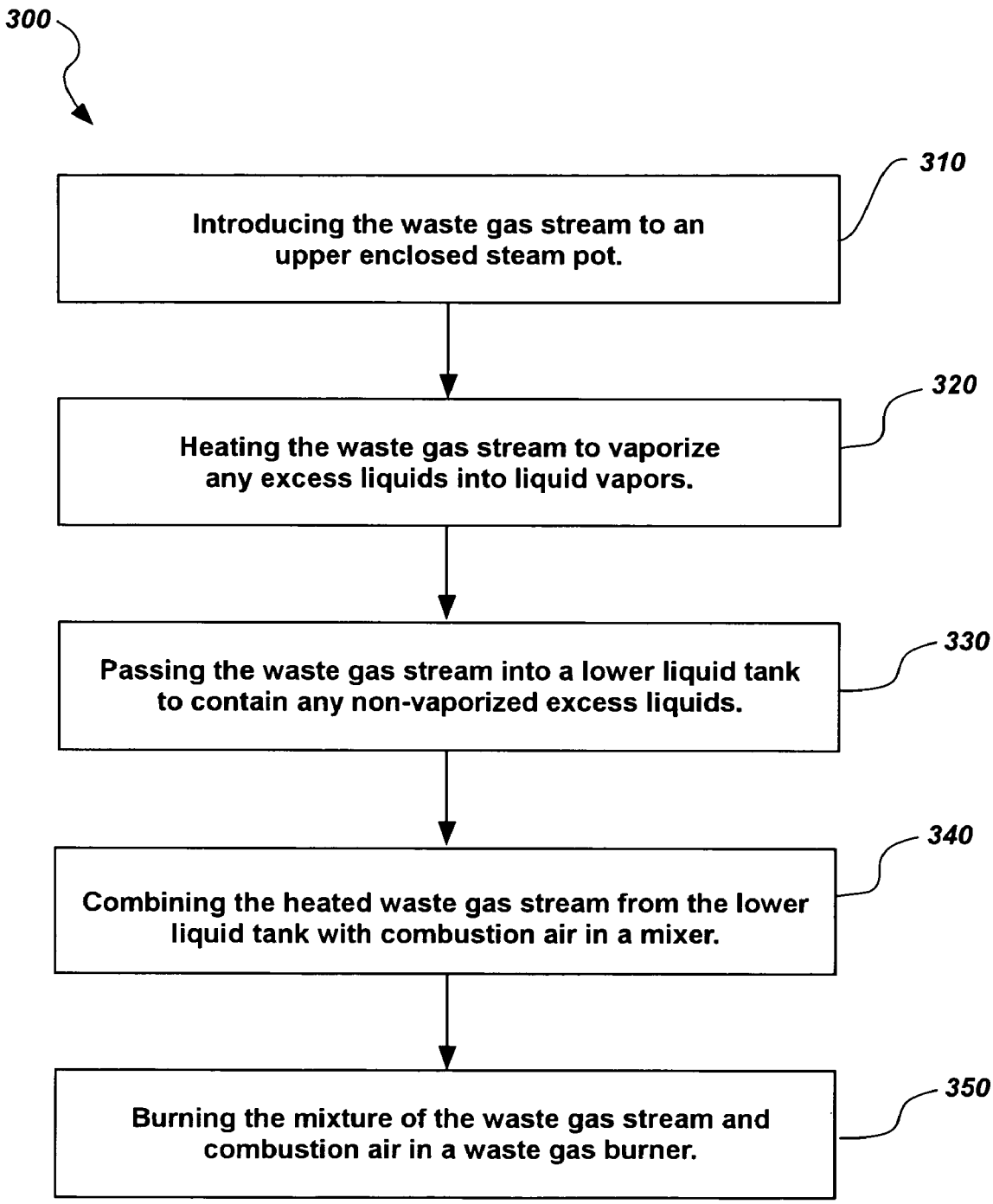
FIG. 7 is a flow chart depicting a method for the method for disposing of entrained pollutants in a waste gas stream, according to an exemplary embodiment of the present invention.

Illustrated in FIG. 7 is a flow chart depicting a method 300 for disposing of entrained pollutants in a waste gas stream. The method can include the operations of introducing 310 the waste gas stream to an upper enclosed steam pot, heating 320 the waste gas stream to vaporize any excess liquids into liquid vapors, and passing 330 the waste gas stream into a lower liquid tank to contain any non-vaporized excess liquids. The method can further include combining 340 the heated waste gas stream from the lower liquid tank with combustion air in a mixer, and burning 350 the mixture of the waste gas stream and combustion air in a waste gas burner.

Figure 8:
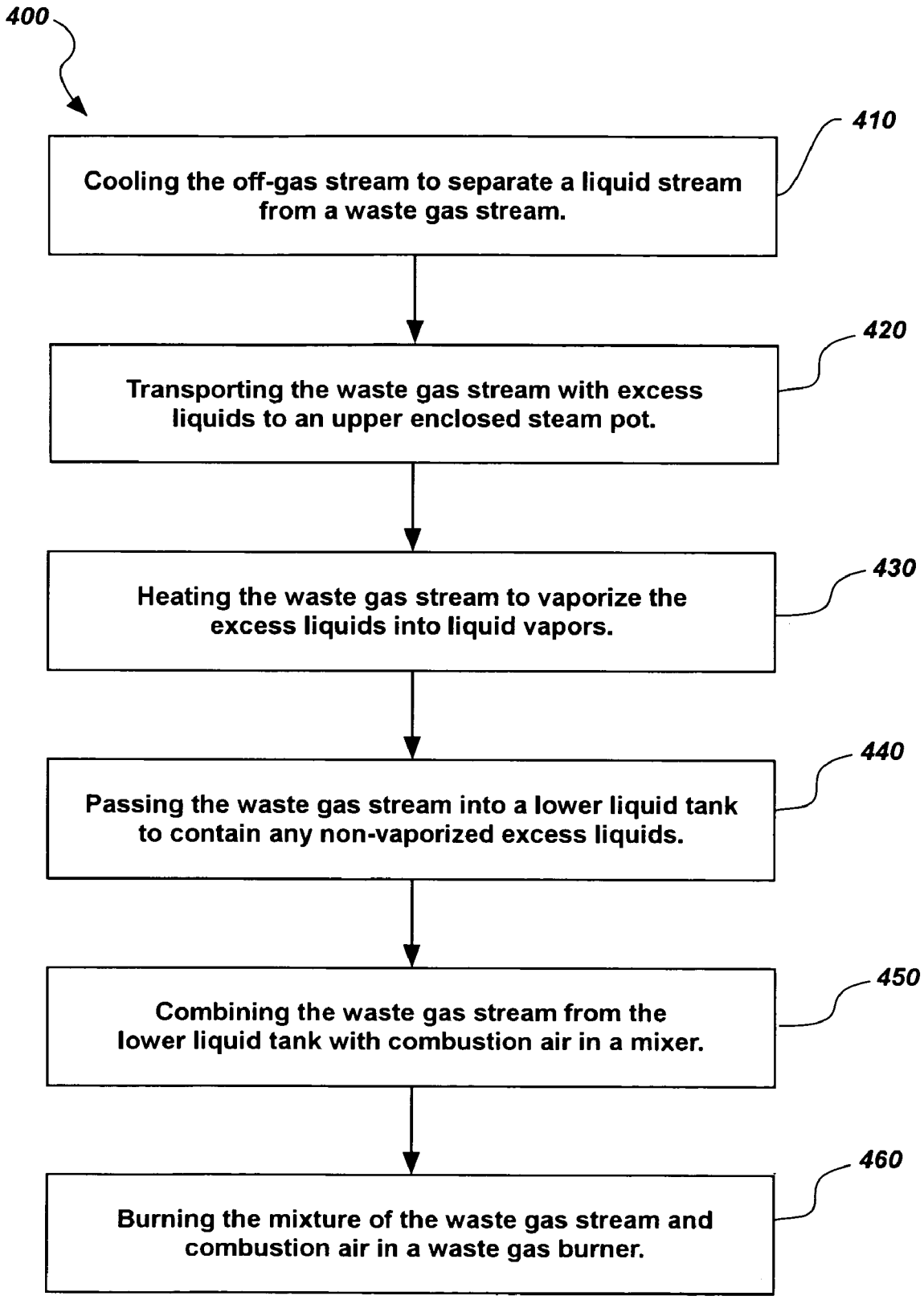
FIG. 8 is a flow chart depicting a method for disposing of entrained pollutants in a dehydrator off-gas waste stream, according to an exemplary embodiment of the present invention.

Shown in the flow chart of FIG. 8 is another embodiment of the present invention, namely a method 400 for disposing of entrained pollutants in a dehydrator off-gas waste stream. This embodiment can include the operations of cooling 410 the waste stream to separate a liquid stream from a waste gas stream and transporting 420 the waste gas stream with excess liquids to an upper steam pot inside a flare stack. The method can further include the steps of heating 430 the waste gas stream to vaporize the excess liquids into liquid vapors, and passing 440 the waste gas stream into a lower liquid tank to contain any non-vaporized excess liquids. The method can also include combining 450 the heated waste gas and liquid vapors with combustion air in a mixer; and finally burning 460 the mixture of waste gas, liquid vapors and combustion air in a waste gas burner.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A flare system for disposing of a waste gas stream and temporarily containing any excess liquids comprising:

a flare stack;

a substantially-enclosed steam pot disposed in the flare stack that receives and heats the waste gas stream and vaporizes liquids in the waste gas stream into liquid vapors, the steam pot having an annular configuration with a hollow center section;

an enclosed liquid tank disposed below the steam pot and in fluid communication with the steam pot that receives the heated waste gas and liquid vapors and temporarily contains any excess non-vaporized liquids; and a waste gas burner assembly comprising;

a waste gas burner in fluid communication with the liquid tank and disposed in the flare stack positioned inside the hollow center section of the steam pot to heat to the steam pot; and means for igniting the heated waste gas and liquid vapors in the waste gas burner.

2. The flare system of claim 1, further comprising a secondary burner located adjacent the waste gas burner for maintaining a constant heat source on the steam pot.

3. The flare system of claim 1, wherein the liquid tank has a volume greater than a volume of the steam pot.

4. The flare system of claim 1, wherein the steam pot is completely enclosed except for a waste gas inlet and at least one outlet to the liquid tank.

5. The flare system of claim 1, further comprising a deflector plate disposed in the stack above the steam pot and waste gas burner assembly, for expanding a zone of combustion above the steam pot and waste gas burner assembly.

6. The flare system of claim 1, further comprising at least one nozzle formed into the upper steam pot allowing a by-pass flow of the heated waste gas and liquid vapors to pass directly into a zone of combustion of the waste gas burner.

7. A flare system for disposing of a waste gas stream and temporarily containing any excess liquids comprising:

a flare stack;

a substantially-enclosed steam pot disposed in the flare stack that receives and heats the waste gas stream and vaporizes liquids in the waste gas stream into liquid vapors;

an enclosed liquid tank disposed below the steam pot and in fluid communication with the steam pot that receives the heated waste gas and liquid vapors and temporarily contains any excess non-vaporized liquids;

a waste gas burner assembly comprising;

a waste gas burner in fluid communication with the liquid tank and disposed in the flare stack adjacent the steam pot to heat to the steam pot; and means for igniting the heated waste gas and liquid vapors in the waste gas burner; and at least one nozzle formed into the upper steam pot allowing a by-pass flow of the heated waste gas and liquid vapors to pass directly into a zone of combustion of the waste gas burner.

8. The flare system of claim 7, wherein the steam pot has an annular configuration with a hollow center section; and wherein the waste gas burner is positioned inside the hollow center section of the steam pot.

9. A flare system for disposing of a waste gas stream and temporarily containing any excess liquids comprising:

a flare stack;

a steam pot assembly supported within the flare stack including;

a substantially-enclosed upper steam pot receiving and heating the waste gas stream and vaporizing liquids in the waste gas stream into liquid vapors, and a lower enclosed liquid tank disposed below and in fluid communication with the upper steam pot receiving the heated waste gas and liquid vapors;

a waste gas burner assembly comprising;

a mixer in fluid communication with the lower liquid tank and a source of combustion air, for mixing the heated waste gas and liquid vapors with the source of combustion air; and a waste gas burner in fluid communication with the mixer and burning a mixture of heated waste gas, liquid vapors and combustion air, and heating the upper steam pot; and means for igniting the mixture of heated waste gas, liquid vapors and combustion air in the waste gas burner, wherein the upper steam pot is configured to direct any excess non-vaporized liquid from the waste gas stream to the lower liquid tank which receives and controls the excess liquid for storage and evaporation.

10. The flare system of claim 9, wherein the upper steam pot has an annular configuration with a hollow center section.

11. The flare system of claim 10, wherein the waste gas burner is positioned inside the hollow center for heating the upper steam pot.

12. The flare system of claim 9, further comprising a secondary burner located adjacent the waste gas burner for maintaining a constant heat source on the steam pot.

13. The flare system of claim 9, wherein the source of combustion air is a plurality of portals configured with flame arrestors disposed in the side of the flare stack.

14. The flare system of claim 9, wherein the liquid tank has a volume greater than a volume of the steam pot.

15. The flare system of claim 9, wherein the upper steam pot is completely enclosed except for a waste gas inlet and an outlet coupled to the liquid tank.

16. The flare system of claim 9, further comprising a deflector plate disposed in the stack above the steam pot assembly and waste gas burner assembly, for expanding a zone of combustion above the steam tank and waste gas burner assembly.

17. A method for disposing of entrained pollutants in a waste gas stream comprising:

introducing the waste gas stream to an upper enclosed steam pot;

heating the waste gas stream to vaporize any excess liquids into liquid vapors;

passing the waste gas stream into a lower liquid tank to contain any non-vaporized excess liquids;

combining the heated waste gas stream from the lower liquid tank with combustion air in a mixer; and burning the mixture of the waste gas stream and combustion air in a waste gas burner.

18. A method for disposing of entrained pollutants in a waste gas stream comprising:

cooling an off-gas stream to separate a liquid stream from a waste gas stream, wherein the waste gas stream contains excess liquids;

transporting the waste gas stream with excess liquids to a substantially-enclosed upper steam pot;

heating the waste gas stream to vaporize at least a portion of the excess liquids into liquid vapors;

passing the heated waste gas and liquid vapors into a lower liquid tank to contain any non-vaporized excess liquids;

combining the heated waste gas and liquid vapors with combustion air in a mixer; and burning the mixture of heated waste gas, liquid vapors and combustion air in a waste gas burner.

19. The method of claim 18, further comprising directing a by-pass flow of the heated waste gas and liquid vapors through at least one nozzle from the upper steam pot directly into a zone of combustion of the waste gas burner.

20. The method of claim 19, further comprising controlling the at least one nozzle to control an amount of by-pass flow passing into the zone of combustion.

* * * * *